US006881289B2

(12) United States Patent
Borderi et al.

(10) Patent No.: US 6,881,289 B2
(45) Date of Patent: Apr. 19, 2005

(54) STRIP SPLICING DEVICE AND METHOD

(75) Inventors: Luca Borderi, Sasso Marconi (IT); Mario Spatafora, Bologna (IT)

(73) Assignee: GD Societa' per Azioni, Bologna (IT)

( * ) Notice: Subject to any disclaimer, the term of this patent is extended or adjusted under 35 U.S.C. 154(b) by 0 days.

(21) Appl. No.: 10/632,142

(22) Filed: Jul. 31, 2003

(65) Prior Publication Data

US 2004/0103978 A1 Jun. 3, 2004

(30) Foreign Application Priority Data

Aug. 8, 2002 (IT) ..... BO2002A0531

(51) Int. Cl.[7] ..... B65H 21/00

(52) U.S. Cl. ..... 156/159; 156/157; 156/504; 156/505; 242/555; 242/556.1

(58) Field of Search ..... 156/157, 159, 156/502, 504, 505; 242/551, 553, 555, 556, 556.1

(56) References Cited

U.S. PATENT DOCUMENTS 3,654,035 A * 4/1972 Takimoto ..... 156/505
3,717,057 A * 2/1973 Takimoto ..... 83/98
3,738,537 A 6/1973 Gach
3,939,031 A * 2/1976 Takimoto ..... 156/505
4,123,314 A * 10/1978 Sundin ..... 156/505
4,234,365 A * 11/1980 Shimizu et al. ..... 156/64
4,315,794 A * 2/1982 Palmieri ..... 156/504
5,131,593 A 7/1992 Siegfried et al.
5,152,858 A * 10/1992 Winter ..... 156/157
5,443,681 A * 8/1995 Stivani et al. ..... 156/504
6,247,515 B1 * 6/2001 Spatafora ..... 156/504

FOREIGN PATENT DOCUMENTS

DE 11 41 848 B 12/1962
EP 0 947 457 A1 10/1999

* cited by examiner

*Primary Examiner*—Mark A. Osele
(74) *Attorney, Agent, or Firm*—Ladas & Parry LLP

(57) ABSTRACT

A device for splicing strips has a first drum rotating about a first axis and having a first outer face for selectively retaining and guiding a first strip; and a second drum rotating about a second axis and having a second outer face for selectively guiding and retaining a second strip; the first and second outer face are so shaped as to form a gap for passage of the strips, and to press the first and second strip and a sticker together as a function of the indexing angles of the first and second drum.

21 Claims, 4 Drawing Sheets

STRIP SPLICING DEVICE AND METHOD

The present invention relates to a strip splicing device.

More specifically, the present invention relates to a strip splicing device for a cigarette packing machine, to which the following description refers purely by way of example.

BACKGROUND OF THE INVENTION

Modern cigarette packing machines operate at extremely high speed, and so consume enormous amounts of packing material, which, when possible, is supplied off reels of strip material, from which sheets of packing material are cut to size. In view of the large amount of packing material consumed, run-out reels must be replaced with new ones, and the respective strips spliced, to ensure continuous supply of the sheets of packing material without stopping the machine. Modern packing machines are therefore equipped with two pins for supporting respective reels; and a device for splicing the strips of the respective reels. Splicing devices provide for joining the end of a new reel strip to a run-out reel strip, and for cutting the run-out reel strip downstream from the splice. The drawbacks of known splicing devices are substantially due to their complexity and, therefore, unreliability.

SUMMARY OF THE INVENTION

It is an object of the present invention to provide a splicing device which is straightforward in design, compact, and extremely reliable.

According to the present invention, there is provided a splicing device for splicing a first strip fed off a first reel, and a second strip fed off a second reel; the device being characterized by comprising a first drum rotating about a first axis and having a first face for selectively retaining and guiding the first strip; and a second drum rotating about a second axis and having a second face for selectively guiding and retaining the second strip; the first and second face being so shaped as to form a gap between said first and said second face, and to selectively press the first and second strip together as a function of given indexing angles of the first and second drum.

The first and second drum provide for retaining, guiding, and splicing the strips, and so obtaining a device which is straightforward, compact and reliable.

The present invention also relates to a strip splicing method.

According to the present invention, there is provided a method of splicing a first strip fed off a first reel, and a second strip fed off a second reel; the second strip having a sticker on its free end; and the method being characterized by guiding the first strip along a first face of a first drum, and retaining said free end of the second strip by means of a second face of a second drum and the sticker on the second face of the second drum; and rotating the first and the second drum about a first and a second axis respectively, to press the first and the second strip and the sticker together and so splice the first and the second strip.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
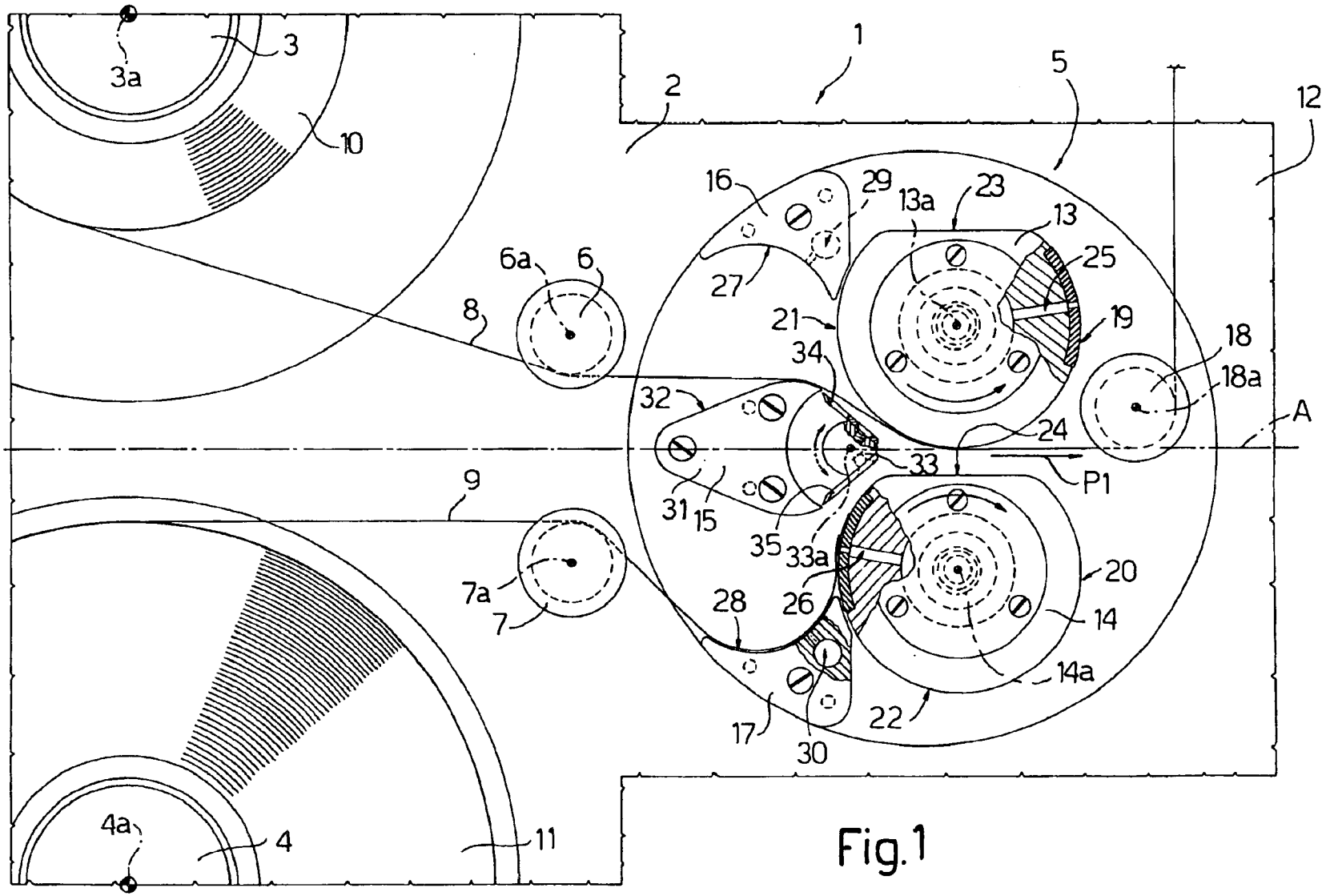
FIG. 1 shows a side view, with parts in section and parts removed for clarity, of a strip feed unit featuring the splicing device according to the present invention.

Number 1 in FIG. 1 indicates as a whole a unit for feeding strips to a packing machine (not shown) for producing packets of cigarettes. Unit 1 comprises a frame 2, which supports two pins 3 and 4, a splicing device 5, and two guide pulleys 6 and 7 for respective strips 8 and 9. Pins 3 and 4 support respective reels 10 and 11, from which respective strips 8 and 9 are unwound; and pins 3, 4 and pulleys 6, 7 rotate about respective axes 3*a*, 4*a*, 6*a*, 7*a* parallel to one another and perpendicular to the FIG. 1 plane.

Figure 5:
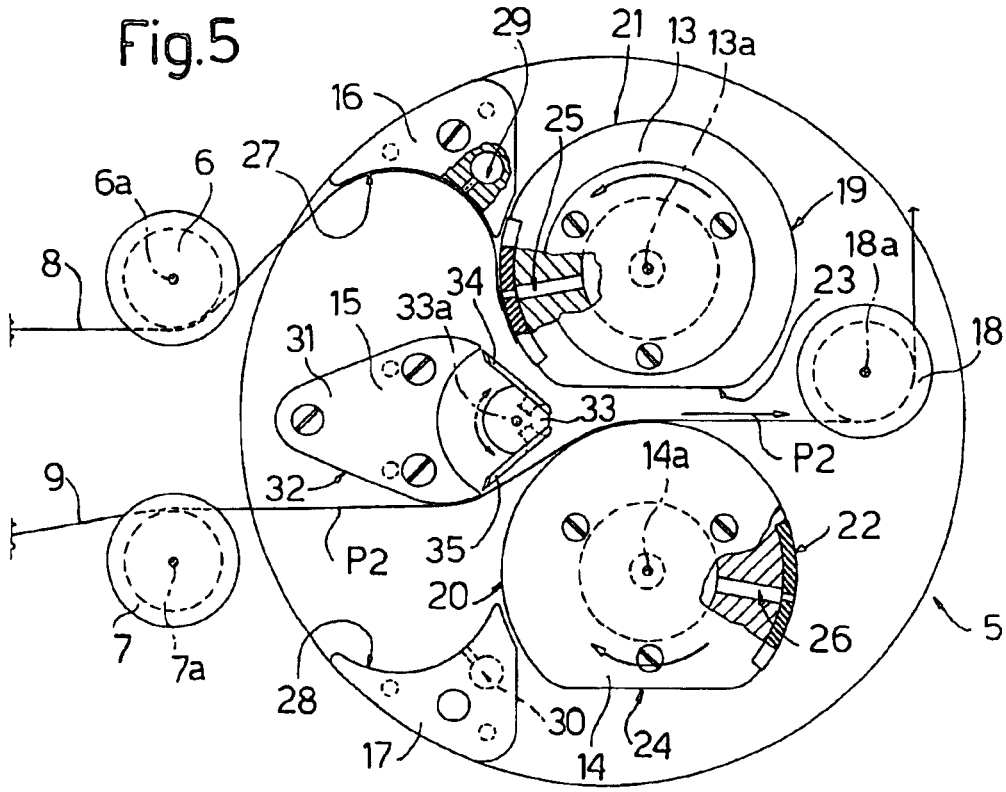
Figure 8:
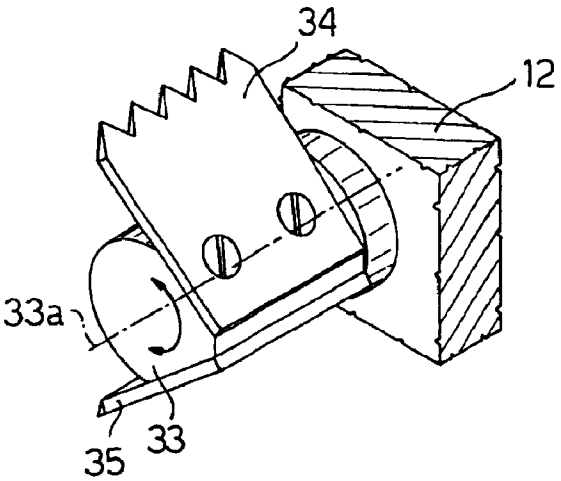
FIGS. 8 and 9 show partly sectioned, larger-scale views in perspective of two details of the FIG. 1 device.

Splicing device 5 is equidistant from pins 3 and 4, and defines, together with pulley 6, a portion of the path P1 of strip 8, and, together with pulley 7, a portion of the path P2 of strip 9 (FIG. 5). Splicing device 5 comprises a plate 12 fixed to frame 2 and fitted with two drums 13 and 14 rotating about respective axes 13*a* and 14*a* parallel to axes 3*a* and 4*a*; a cutting tool 15; two plates 16 and 17 adjacent to first and second drum 13 and 14 respectively; and a guide pulley 18, which rotates about an axis 18*a* parallel to axes 13*a* and 14*a*, and defines both paths P1 and P2. Unit 1 and device 5 are substantially specularly symmetrical with respect to an axis A.

Each drum 13, 14 has a cylindrical face 19, 20 looped about axis 13*a*, 14*a* and defined by a curved face 21, 22 extending about axis 13*a*, 14*a*, and by a flat face 23, 24 parallel to axis 13*a*, 14*a*. The term cylindrical face is used in the sense of a cylinder being any solid defined by generating lines parallel to an axis and distributed along a closed path about the axis. In other words, curved faces 21 and 22 are defined by generating lines parallel to axes 13*a* and 14*a* and distributed along two arcs extending more than 180° about axes 13*a* and 14*a*, and flat faces 23 and 24 are defined by generating lines parallel to axes 13*a* and 14*a* and distributed along two chords, which subtend two arcs of less than 180° and complementary to the previous arcs. Consequently, the distance (radius) between axes 13*a*, 14*a* and curved faces 21, 22 is greater than the distance (chord distance) between flat faces 23, 24 and axes 13*a*, 14*a*. In fact, the circular shape of drums 13 and 14 is interrupted by flat faces 23 and 24, which connect the ends of curved faces 21 and 22. Drums 13 and 14 also comprise respective suction channels 25 and 26, which come out along faces 21 and 22, close to faces 23 and 24; and drums 13 and 14 rotate in opposite directions about respective axes 13*a* and 14*a* to assume a first rest position (FIG. 1) and a second rest position (FIG. 5), in which they are offset angularly by 180° with respect to a symmetrical position with respect to axis A. That is, both flat faces 23 and 24 are parallel and face upwards in FIG. 1, and are parallel and face downwards in FIG. 5.

Plates 16 and 17 have respective concave faces 27 and 28, which face each other, communicate with respective suction channels 29 and 30, and have respective ends adjacent to respective drums 13 and 14.

Cutting tool 15 is located along axis of symmetry A, between pins 3, 4 and drums 13, 14, and comprises a fixed portion 31 for guiding strips 8 and 9 along a face 32 perpendicular to the FIG. 1 plane; and a movable assembly 33 movable about an axis 33*a* perpendicular to the FIG. 1 plane. Face 32, together with face 21 of face 19 of drum 13, defines part of path P1 of strip 8, and, together with face 22 of face 20 of drum 14, defines part of path P2 of strip 9. Movable assembly 33 comprises two blades 34 and 35, which are movable between a rest position, not interfering with paths P1 and P2; a first work position, in which blade 34 interferes with path P1 to cut strip 8; and a second work position, in which blade 35 interferes with path P2 to cut strip 9.

Figure 2:
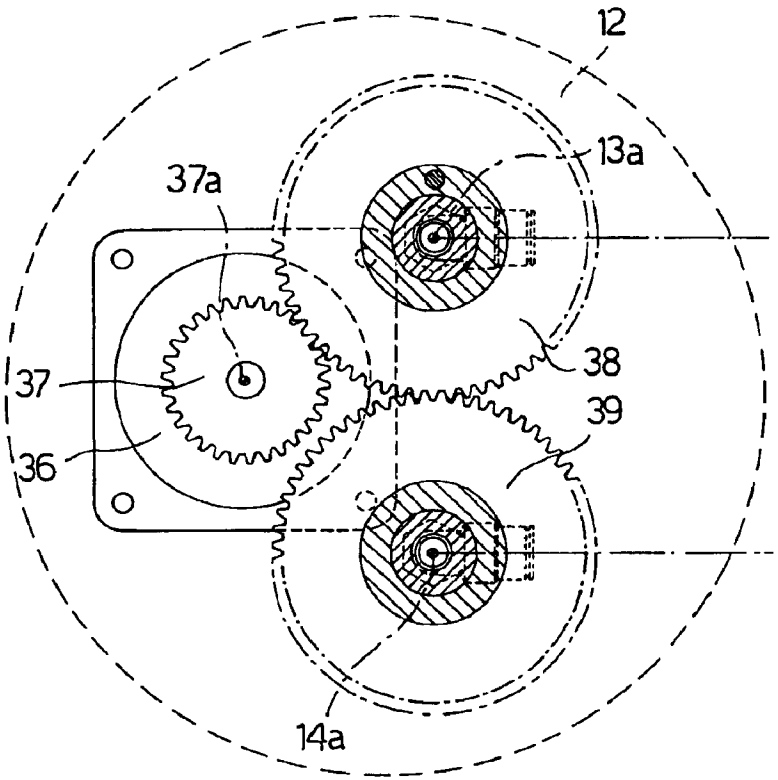

Drums 13, 14 and assembly 33 are rotated about respective axes 13*a*, 14*a*, 33*a* by a single drive member 36 shown schematically in FIG. 2. Drive member 36, which is preferably an electric step motor, drives a gear 37, which rotates about an axis 37*a* and meshes with a gear 38 integral with drum 13 and rotating about axis 13*a*. Gear 38 meshes with a gear 39 integral with drum 14 and rotating about axis 14*a*.

Figure 3:
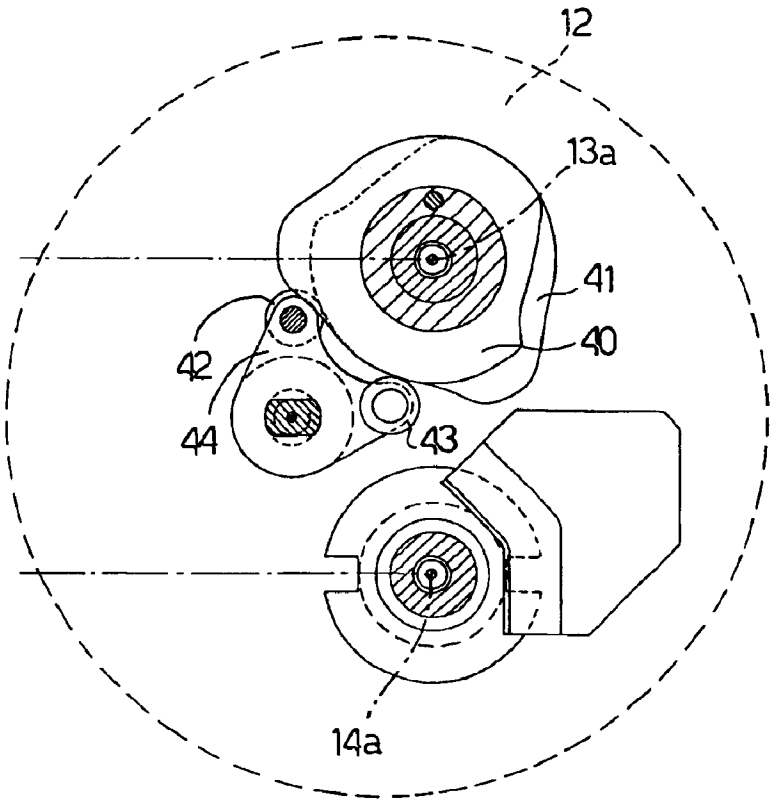
FIGS. 2 and 3 show side views, with parts in section and parts removed for clarity, of mechanisms of the FIG. 1 device.

With reference to FIG. 3, drum 13 is integral with two cams 40 and 41, which rotate about axis 13*a*, and cooperate with two tappets 42 and 43 on the free ends of a fork 44 integral with movable assembly 33 to swing blades 34 and 35 about axis 33*a* as a function of the position of drums 13 and 14.

In actual use, and with reference to FIG. 1, strip 8 is fed off reel 10 and along path P1 to the packing machine (not shown), which exerts pull on strip 8 to stretch it between reel 10, pulley 6, face 32 of cutting tool 15, curved face 21 of drum 13, and pulley 18, to define path P1 of strip 8. In other words, strip 8, drawn by the packing machine (not shown), slides on faces 32 and 21, and rolls about pulleys 6 and 18.

Figure 9:
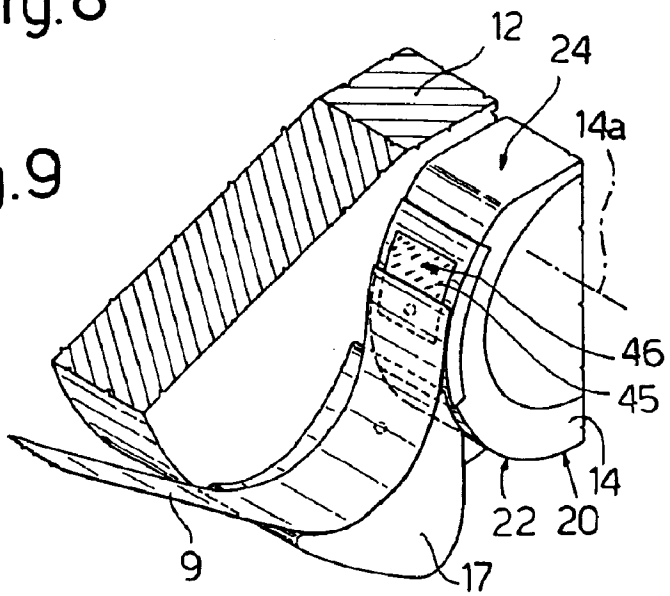
Figure 6:
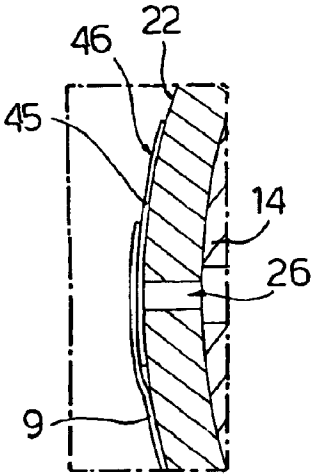
FIGS. 6 and 7 show larger-scale side views of two details of FIGS. 1 and 4 respectively.

On the other side of axis A, strip 9 has a free end with a sticker 45 with an adhesive face 46, as shown more clearly in FIG. 6. With reference to FIG. 9, strip 9 partly rests on concave face 28, and the end of strip 9 rests on face 22 of face 20 of drum 14, at suction channel 26. In this position, adhesive face 46 of sticker 45 faces outwards, as shown clearly in FIG. 6.

With reference to FIG. 1, respective flat faces 23 and 24 of drums 13 and 14 are positioned parallel and facing upwards, so that flat face 24 of drum 14 faces and is a given distance from curved face 21, along which strip 8 runs. In this first rest position of drums 13 and 14, a gap for the passage of strip 8 is defined between faces 21 and 24.

Figure 4:
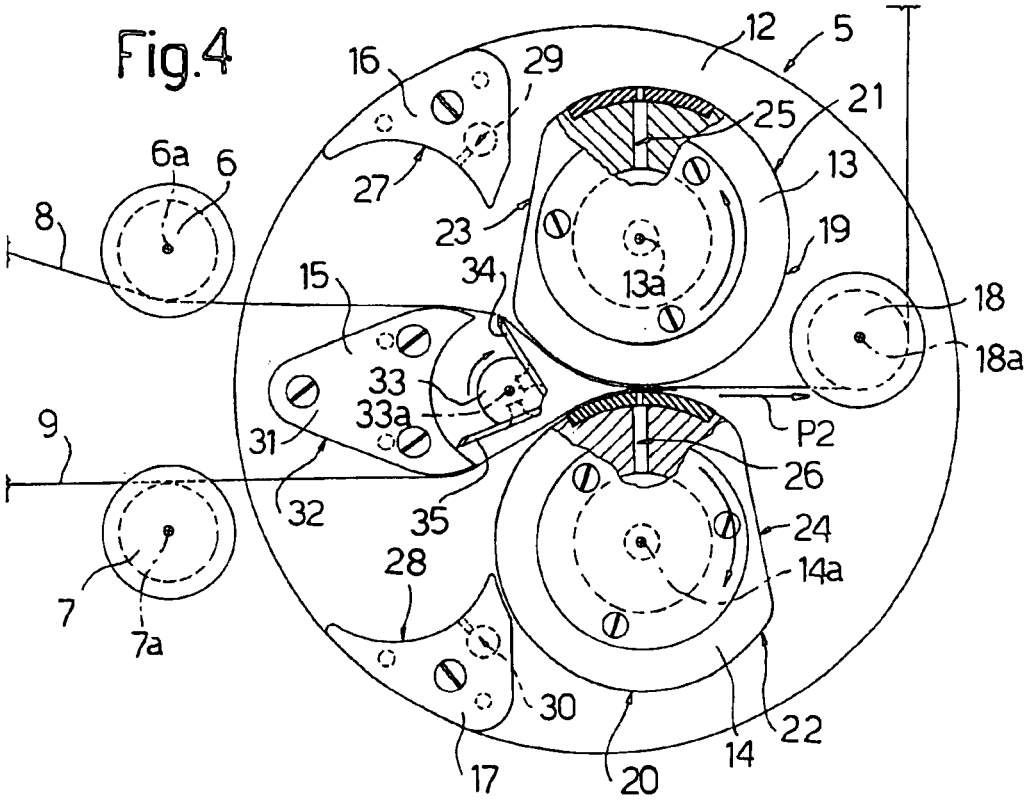
FIGS. 4 and 5 show side views, with parts in section and parts removed for clarity, of the FIG. 1 device in two different configurations.
Figure 7:
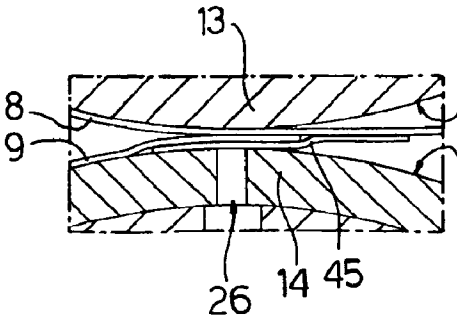

As reel 10 is about to run out, device 5, in addition to guiding and supporting strips 8 and 9, commences the splicing process, which, as shown in FIGS. 4 and 7, comprises synchronously rotating drum 14 clockwise and drum 13 anticlockwise by means of drive member 36 and gears 37, 38, 39 (FIG. 2), so that curved faces 21 and 22 face each other and press together strip 8, strip 9, and sticker 45, the adhesive face 46 of which adheres to strip 8 (FIG. 7). Rotation of drum 13 also rotates cams 40 and 41, which swing blades 34 and 35 clockwise in FIG. 1, so that blade 34 interferes with path P1 of strip 8 to cut strip 8. Further rotation brings drums 13 and 14 into the second rest position (FIG. 5), in which flat faces 23 and 24 face downwards. In other words, splicing is effected by simply rotating drums 13 and 14 180° in opposite directions. In the second rest position shown in FIG. 5, strip 9 is fed along path P2 to the packing machine (not shown). Strip 9, drawn by the packing machine (not shown) runs along curved face 22, which faces flat face 23 of drum 13 to form a gap for the passage of strip 9.

In the meantime, the run-out reel 10 is changed with a new one, from which a strip 8 is unwound and placed resting on concave face 27. The free end of strip 8 has a sticker 45 with an adhesive face 46, and is placed on face 21, at suction channel 25, so that splicing device 5 is ready to splice strips 8 and 9 as reel 11 is about to run out. Splicing is effected by further rotating drums 13 and 14 into the first rest position (FIG. 1), in the course of which, cams 40 and 41 swing movable assembly 33 in the opposite direction to before to cut strip 9.

Throughout, the rotation direction of drums 13 and 14 is never inverted: drum 13 is always rotated anticlockwise, and drum 14 clockwise. Which functional characteristic depends substantially on the shape of drums 13 and 14, and provides for simplifying the actuating mechanisms of splicing device 5.

What is claimed is:

1. A splicing device for splicing a first strip (8) fed off a first reel (10), and a second strip (9) fed off a second reel (11); the device comprising a first drum (13) rotating about a first axis (13*a*) and having a first face (19) for selectively retaining and guiding the first strip (8);

a second drum (14) rotating about a second axis (14*a*) and having a second face (20) for selectively guiding and retaining the second strip (9); wherein the first and second face (19, 20) are so shaped as to form a gap between said first and said second face (19, 20), and to selectively press the first (8) and second (9) strip together as a function of given indexing angles of the first and second drum (13, 14); and a cutting tool (15) comprising a fixed portion (31) and a movable assembly (33) and located along an axis (A) of symmetry of the splicing device (5); the axis (A) of symmetry extending between said first and said second drum (13, 14); wherein the fixed portion (31) comprises an outer face (32), which defines, together with the first drum (13), a portion of a first path (P1) of the first strip (8), and defines, together with the second drum (14), a portion of a second path (P2) of the second strip (9).

2. A device as claimed in claim 1, wherein the first and second face (19, 20) are looped respectively about the first and second axis (13*a*, 14*a*), and comprise, respectively, a first and a second curved face (21, 22), which press the first and second strip (8, 9) together at given indexing angles of the first and second drum (13, 14).

3. A device as claimed in claim 2, wherein the first and second face (19, 20) respectively comprise a first and a second connecting face (23, 24); the curved faces (21, 22) being located at a greater distance than the first and second connecting face (23, 24) from the respective first and second axis (13*a*, 14*a*).

4. A device as claimed in claim 3, wherein the first and second connecting face (23, 24) are flat and parallel to the first and second axis (13*a*, 14*a*) respectively.

5. A device as claimed in claim 2, wherein said first and said second drum (13, 14) have respective suction channels (25, 26), which come out along the first and second face (19, 20) respectively to retain the respective free ends of the first and second strip (8, 9).

6. A device as claimed in claim 1, wherein the movable assembly (33) comprises a first and a second blade (34, 35), and swings about a third axis (33*a*) to selectively position the first blade (34) to interfere with the first strip (8) along the first path (P1), and the second blade (35) to interfere with the second strip (9) along the second path (P2).

7. A device as claimed in claim 1, wherein the first and second drum (13, 14) and the movable assembly (33) are driven by a single drive member (36).

8. A device as claimed in claim 7, wherein the first and second drum (13, 14) are connected to each other by respective gears (38, 39).

9. A device as claimed in claim 7, and comprising at least one cam (40, 41) rotating about one of the axes (13*a*, 14*a*) of the first and second drum (13, 14) and integral with the first and second drum (13, 14); said movable assembly (33) being integral with at least one tappet (42, 43) to activate the blades (34, 35) as a function of the position of the first and second drum (13; 14).

10. A device as claimed in claim 1, comprising a first and a second plate (16, 17) comprising, respectively, a first and a second seating face (27, 28), along which respective suction channels (29, 30) come out to retain the first and second strip (8, 9).

11. A device as claimed in claim 10, wherein the first and second seating face (27, 28) have ends adjacent to the first and second drum (13, 14) respectively.

12. A device as claimed in claim 10, wherein the first and second seating face (27, 28) face each other.

13. A device as claimed in claim 10, wherein the first and second seating face (27, 28) are concave.

14. A method of splicing a first strip (8) fed off a first reel (10), and a second strip (9) fed off a second reel (11); the second strip (9) having a sticker (45) on its free end; and the method comprising the steps of guiding the first strip (8) along a first face (19) of a first drum (13), retaining said free end of the second strip (9) by means of a second face (20) of a second drum (14) and the sticker (45) on the second face (20) of the second drum (14);

rotating the first and the second drum (13, 14) about a first and a second axis (13*a*, 14*a*) respectively, to press the first and the second strip (8, 9) and the sticker (45) together and so splice the first and the second strip (8, 9);

stretching the first strip (8) between a fixed portion (32) of a cutting tool (15) and the first drum (13);

moving a blade (34) into a position to interfere with said first strip (8); and cutting said first strip (8) between said fixed portion (32) and the first drum (13).

15. A method as claimed in claim 14, wherein the first and second face (19, 20) respectively comprise a first and a second curved face (21, 22); and a first and a second connecting face (23, 24), the distance of which from the respective first and second axis (13*a*, 14*a*) is less than the distance between the first and second curved face (21, 22) and the respective first and second axis (13*a*, 14*a*).

16. A method as claimed in claim 15, and comprising the step of indexing said first and said second drum (13, 14) about the first and second axis (13*a*, 14*a*) respectively, so as to position the first curved face (21) facing the second connecting face (24) to allow the first strip (8) to run along the first drum (13).

17. A method as claimed in claim 15, and comprising the step of indexing the first and second drum (13, 14), so that the first curved face (21) faces the second curved face (22) to press the first and second strip (8, 9) and said sticker (45) together.

18. A method as claimed in claim 14, and comprising the step of indexing the first and second drum (13, 14) to position the first connecting face (23) facing the second curved face (22), so as to allow the second strip (9) to run on the second curved face (22).

19. A splicing device for splicing a first strip (8) fed off a first reel (10), and a second strip (9) fed off a second reel (11); the device comprising a first drum (13) rotating about a first axis (13*a*) and having a first face (19) for selectively retaining and guiding the first strip (8);

a second drum (14) rotating about a second axis (14*a*) and having a second face (20) for selectively guiding and retaining the second strip (9); wherein the first and second faces (19, 20) are so shaped as to form a gap between said first and said second faces (19, 20), and to selectively press the first (8) and second (9) strips together as a function of given indexing angles of the first and second drums (13, 14);

a cutting tool (15) comprising a fixed portion (31) and a movable assembly (33) and located along an axis (A) of symmetry of the splicing device (5); wherein the axis (A) of symmetry extends between said first and said second drum (13, 14); and a single drive member (36) driving the first and second drum (13, 14) and the movable assembly (33).

20. A device as claimed in claim 19, wherein the first and second drum (13, 14) are connected to each other by respective gears (38, 39).

21. A device as claimed in claim 19, further comprising at least one cam (40, 41) rotating about one of the axes (13*a*, 14*a*) of the first and second drums (13, 14) and integral with the first and second drums (13, 14); said movable assembly (33) being integral with at least one tappet (42, 43) to activate the blades (34, 35) as a function of the position of the first and second drums (13; 14).

* * * * *

UNITED STATES PATENT AND TRADEMARK OFFICE

CERTIFICATE OF CORRECTION

PATENT NO. : 6,881,289 B2
DATED : April 19, 2005
INVENTOR(S) : Luca Borderi et al.

It is certified that error appears in the above-identified patent and that said Letters Patent is hereby corrected as shown below:

Title page,
Item [73], Assignee, "GD" should read -- G. D --.

Signed and Sealed this

Second Day of August, 2005

JON W. DUDAS
*Director of the United States Patent and Trademark Office*